US007641331B2

(12) United States Patent
Chen

(10) Patent No.: US 7,641,331 B2
(45) Date of Patent: Jan. 5, 2010

(54) STAR WHEEL RELEASING MECHANISM OF PRINTING APPARATUS

(75) Inventor: Chih-Ren Chen, Kaohsiung (TW)

(73) Assignee: Qisda Corporation, Taoyuan County (TW)

( * ) Notice: Subject to any disclaimer, the term of this patent is extended or adjusted under 35 U.S.C. 154(b) by 565 days.

(21) Appl. No.: 11/380,678

(22) Filed: Apr. 28, 2006

(65) Prior Publication Data

US 2006/0244802 A1 Nov. 2, 2006

(30) Foreign Application Priority Data

Apr. 27, 2005 (TW) ..... 94113553 A

(51) Int. Cl.
*B41J 13/02* (2006.01)
*B65H 29/20* (2006.01)

(52) U.S. Cl. ..... 347/104; 400/637.2

(58) Field of Classification Search ..... 400/637.2, 400/638

See application file for complete search history.

(56) References Cited

U.S. PATENT DOCUMENTS 5,636,929 A * 6/1997 Asano et al. ..... 400/641
5,775,824 A * 7/1998 Bae ..... 400/636
7,137,698 B2 * 11/2006 Miyake et al. ..... 347/104

FOREIGN PATENT DOCUMENTS

JP 63146657 A * 6/1988
JP 01222969 A * 9/1989
JP 11277841 A * 10/1999

* cited by examiner

*Primary Examiner*—Daniel J Colilla

(57) ABSTRACT

A star wheel releasing mechanism for a printing apparatus is described. The star wheel releasing mechanism comprises a base, the exit wheels disposed at the base, a star wheel module, a pair of supporting plates and a front cover. The base includes a first side and a second side. The star wheel module having a plurality of star wheels is movably disposed on the base. The supporting plates are oppositely disposed at the first side and the second side of the base. Each supporting plate has an arc slot. Two ends of the star wheel module are respectively slidable within the arc slots of two supporting plates. The front cover pivoted on the supporting plates and connected to the star wheel module is movable between a first position and a second position.

17 Claims, 7 Drawing Sheets

STAR WHEEL RELEASING MECHANISM OF PRINTING APPARATUS

This application claims the benefit of Taiwan application Serial No. 094113553, filed Apr. 27, 2005, the subject matter of which is incorporated herein by reference.

BACKGROUND OF THE INVENTION

1. Field of the Invention

The present invention relates to a star wheel releasing mechanism, and more particularly, to a star wheel releasing mechanism installed in a printing apparatus for increasing a space which is used for changing an ink cartridge and eliminating the problem of paper jam.

2. Description of the Related Art

A top-flip-cover design is widely used in a current printer, or a current multi-function peripheral (MFP) that includes the functions of copying, scanning, faxing, and printing, etc. The top-flip-cover design is good for changing an ink cartridge disposed in the printing apparatus or the multi-function peripheral (MFP). Please refer to FIG. 1, which depicts a perspective view showing a top-flip-cover type multi-function peripheral (MFP) of the prior art. It is usually designed that a scanning component is disposed in the upper part of the multi-function peripheral 100. That is, the scanning component is disposed near the top cover 110 of the multi-function peripheral 100. The top cover 110 with the scanning components is rotated upwards to expose the inner structure of the multi-function peripheral 100 during changing an ink cartridge 120. However, there are some shortcomings for the prior top-flip-cover multi-function peripheral (MFP) 100. For example, the top cover 110 is rotated to a predetermined angle for changing the ink cartridge. During the opening of the top cover 110, a supporting device is usually used for supporting and maintaining the top cover 110 at the predetermined angle for preventing the top cover 110 from falling. Furthermore, a pivoting device used for rotating the top cover 110 is necessary and occupies lots of space. It accordingly increases the manufacturing cost and does not meet the requirements of lightweight and small volume for electronic devices. In addition, dust usually drops into the multi-function peripheral 100 to contaminate the inside components and degrade the printing performance during the top cover 110 opened for changing the ink cartridge.

To overcome the above problems, a non-flip-cover design is provided instead of the above-mentioned top-flip-cover design. However, the non-flip-cover design is very inconvenient for changing the ink cartridge and other components inside the multi-function peripheral. Reference is made to FIG. 2, which depicts a perspective view showing a non-flip-cover type multi-function peripheral (MFP) of the prior art. A star wheel 240 is disposed fixedly in the non-flip-cover multi-function peripheral (MFP) 200. As shown in FIG. 2, there is only an entrance opened on the front side of the multi-function peripheral (MFP) 200 for user to change an ink cartridge or other components.

Since the star wheel 240 occupies lots of the entrance space of the multi-function peripheral (MFP) 200, an operating space remained from the entrance space for user changing an ink cartridge or resolving the paper jam problem becomes very small and narrow. And the small operating space makes user get injured easily by the inside components of the multi-function peripheral (MFP) 200, and makes it difficult and wasting time to change an ink cartridge or resolve the paper jam problem.

SUMMARY OF THE INVENTION

It is an aspect of the present invention to provide a star wheel releasing mechanism installed in a printing apparatus. A star wheel module of the star wheel releasing mechanism could be moved forward and downward in linkage with a front cover, so that increasing a space used for changing an ink cartridge and eliminating the paper jam.

According to the aforementioned aspect of the present invention, a star wheel releasing mechanism is provided, which is installed in a printing apparatus. The star wheel releasing mechanism comprises: a base; a plurality of exit wheels; a star wheel module; a pair of supporting plates; and a front cover. The base includes a first side and a second side. The exit wheels are disposed on the base. The star wheel module having a first end and a second end is movably disposed on the base, and includes a plurality of star wheels, whose positions correspond to the positions of the exit wheels. The pair of supporting plates are disposed respectively on the first side and the second side of the base. Each of the supporting plates includes an arc slot, wherein the first end and the second end of the star wheel module are respectively slidable within the arc slots. The front cover pivoted on the supporting plates and connected with the star wheel module is movable between a first position and a second position.

When the front cover is in the first position (in a closed state), the star wheels are locked with the corresponding exit wheels. When the front cover is transferred from the first position to the second position (in an opened state), the star wheel module moves in linkage with the front cover, and the star wheels are separated from the exit wheels.

According to the aforementioned aspect of the present invention, a printing apparatus is provided. The printing apparatus comprises a printing carriage and a star wheel releasing mechanism. The star wheel releasing mechanism for use in connection with the printing carriage comprises: a base; a plurality of exit wheels; a star wheel module; a pair of supporting plates; and a front cover. The base includes a first side and a second side. The exit wheels are disposed on the base. The star wheel module having a first end and a second end is movably disposed on the base, and includes a plurality of star wheels, whose positions correspond to the positions of the exit wheels. The pair of supporting plates are disposed respectively on the first side and the second side of the base. Each of the supporting plates includes an arc slot, wherein the first end and the second end of the star wheel module are respectively slidable within the arc slots. The front cover pivoted on the supporting plates and connected to the star wheel module is movable between a first position and a second position.

When the front cover is in the first position (in a closed state), the star wheels are locked with the corresponding exit wheels. When the front cover is transferred from the first position to the second position (in an opened state), the star wheel module moves in linkage with the front cover, and the star wheels are separated from the exit wheels. Furthermore, when the front cover is positioned in the second position (in the opened state), the horizontal height of the star wheels is lower than the horizontal height of the printing carriage, for increasing a space used for changing an ink cartridge and eliminating the paper jam.

The printing apparatus further comprises an output tray, which is rotatably connected with a front side of the printing apparatus, and is disposed outside the front cover for carrying an output paper.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

The present invention provides a star wheel releasing mechanism installed in a printing apparatus. When a front cover of the printing apparatus is pulled down, a star wheel module is moved in linkage forward and downward, so that more space is provided for user to change an ink cartridge or resolve the paper jam problem. After operating, the front cover is closed and the star wheel module is moved back to the original position, the printing function of the printing apparatus can still process without interruption.

The star wheel releasing mechanism of the present invention could be applied to any kind of printing apparatus, such as a printer, or a multi-function peripheral (MFP) which includes the functions of copying, scanning, faxing, and printing, etc. The following embodiment of the present invention is illustrated of the present invention rather than limiting of the present invention. Also, a top cover of the present printing apparatus is not shown in all of the Figures for illustrating the inside components of the printing apparatus clearly.

Figure 1:
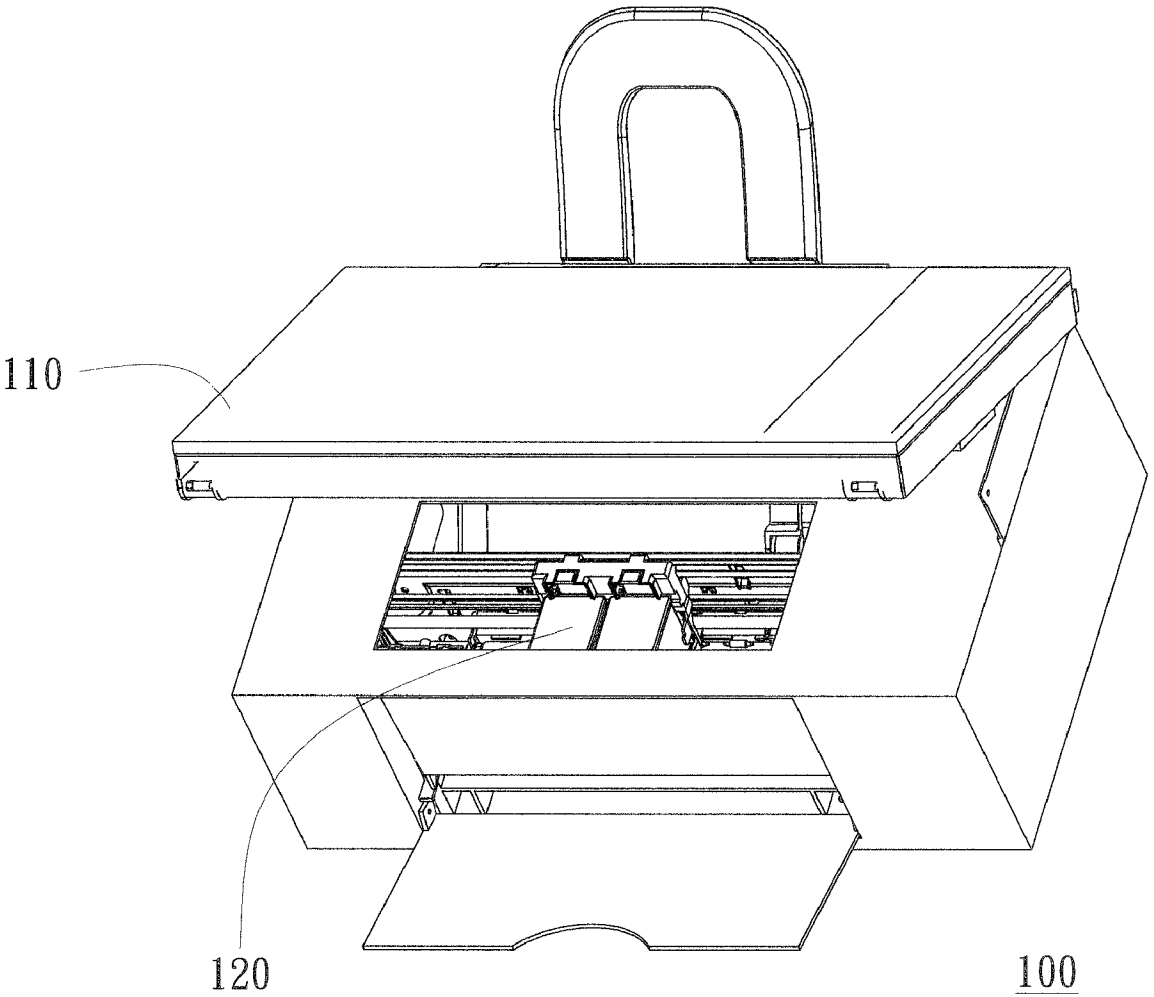
FIG. 1(PRIOR ART)
FIG. 1 (prior art) depicts a perspective view showing a top-flip-cover multi-function peripheral (MFP) of the prior art.
Figure 2:
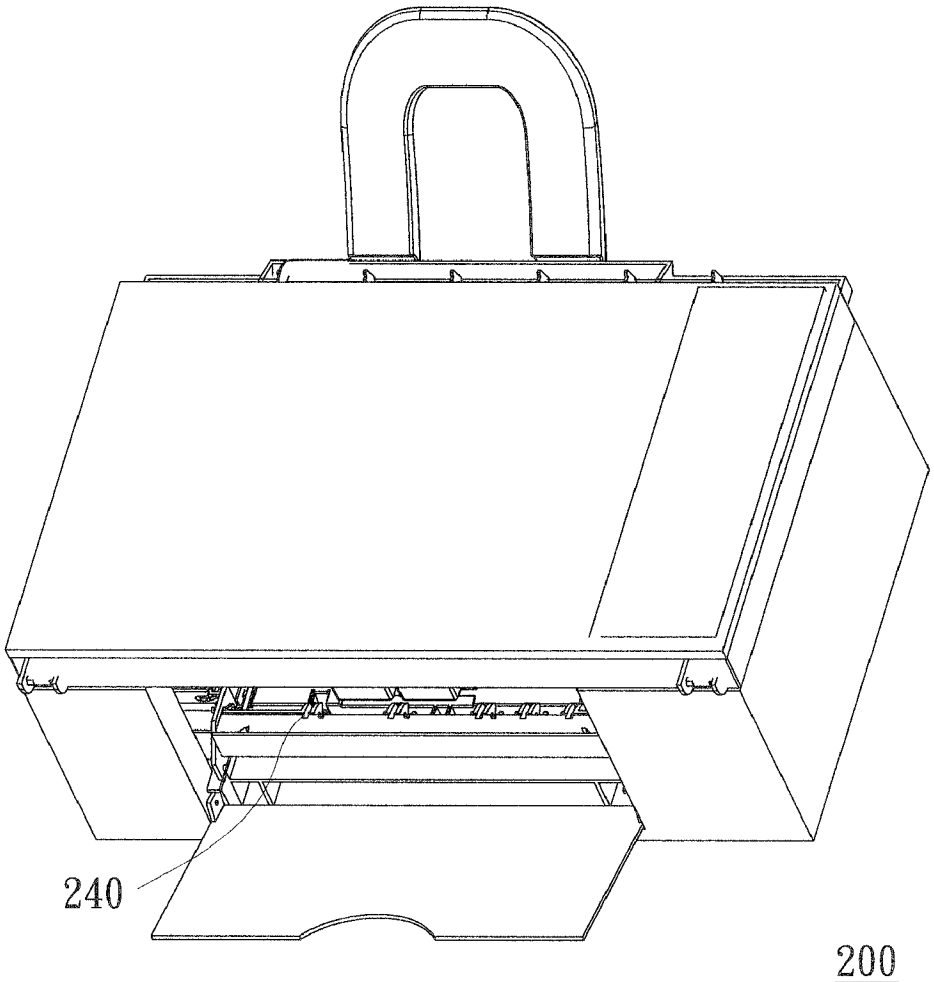
FIG. 2(PRIOR ART)
FIG. 2 (prior art) depicts a perspective view showing a non-flip-cover multi-function peripheral (MFP) of the prior art.
Figure 3:
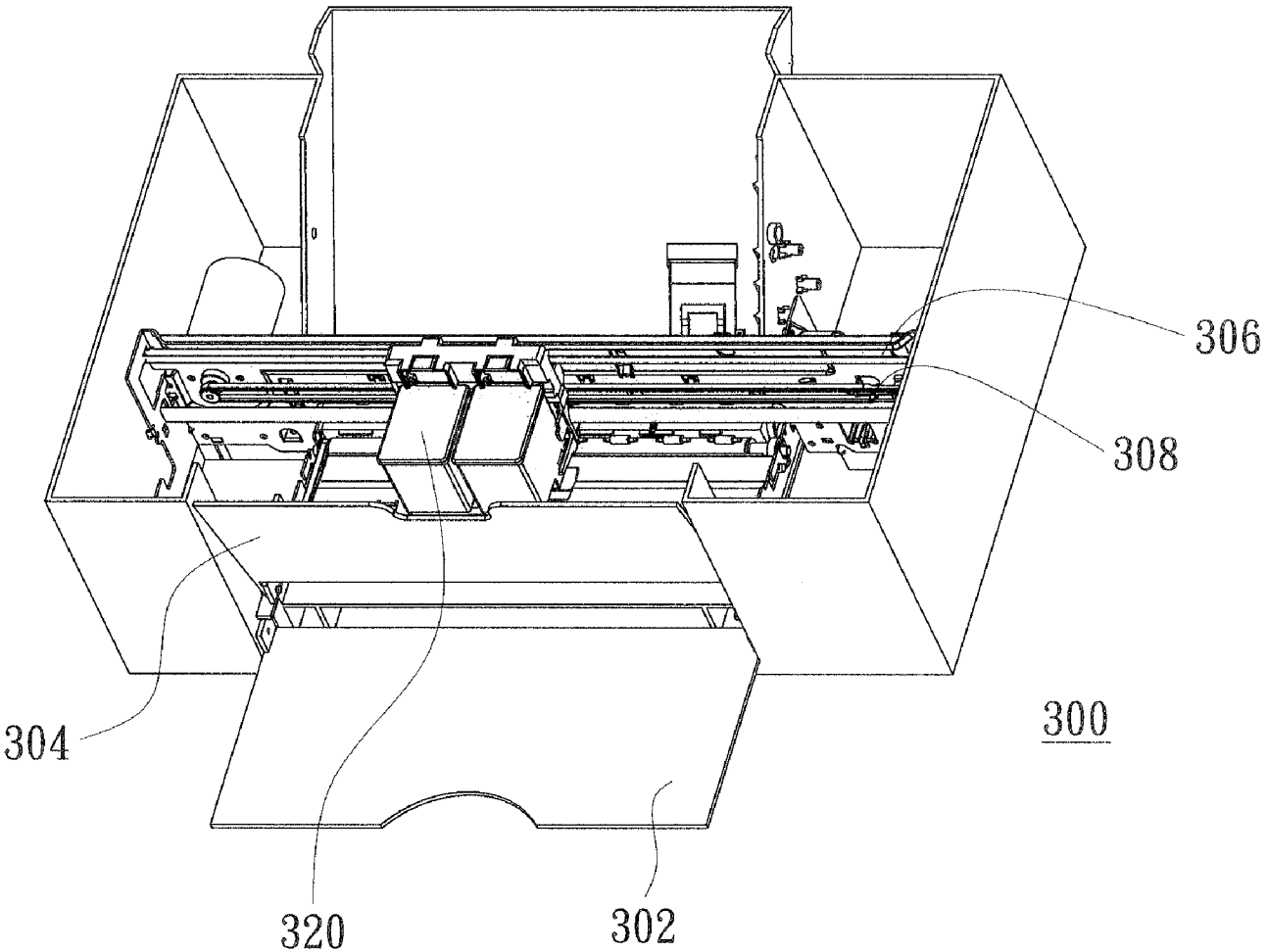
FIG. 3 depicts a perspective view showing a printing apparatus with a star wheel releasing mechanism in accordance with a preferred embodiment of the present invention.

Reference is made to FIG. 3, which depicts a perspective view showing a printing apparatus with a star wheel releasing mechanism in accordance with a preferred embodiment of the present invention. There is an output tray 302 disposed on a front side of the printing apparatus 300. The output tray 302 is rotatably connected with the front side of the printing apparatus 300 for carrying an output paper. A front cover 304 disposed on the front side of the printing apparatus 300 is opened outwardly to provide an opening for changing an ink cartridge 320 or eliminating paper jam. When it is no need to change the ink cartridge 320 or eliminate the paper jam, the front cover 304 is closed, as shown in FIG. 3. When the user needs to change the ink cartridge 320 or eliminate the paper jam, the front cover 304 could be pulled down, like the output tray 302 shown in FIG. 3. Furthermore, the ink cartridge 320 sleeves on a shaft 308 of a frame 306, so that the ink cartridge 320 is slidable along the shaft 308 forward and backward during printing process.

Figure 4A:
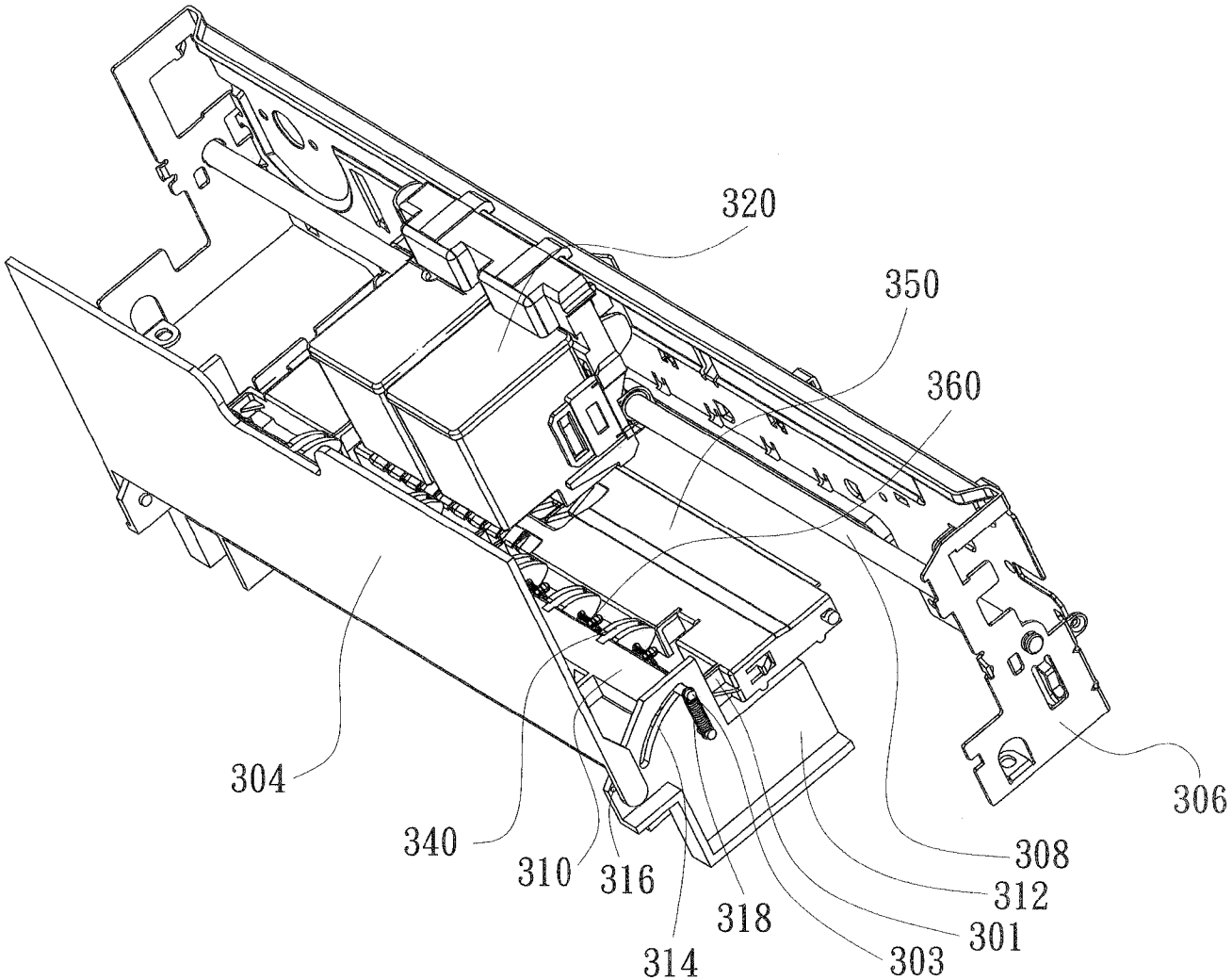
FIG. 4A depicts a perspective view showing the star wheel releasing mechanism in accordance with FIG. 3.
Figure 4B:
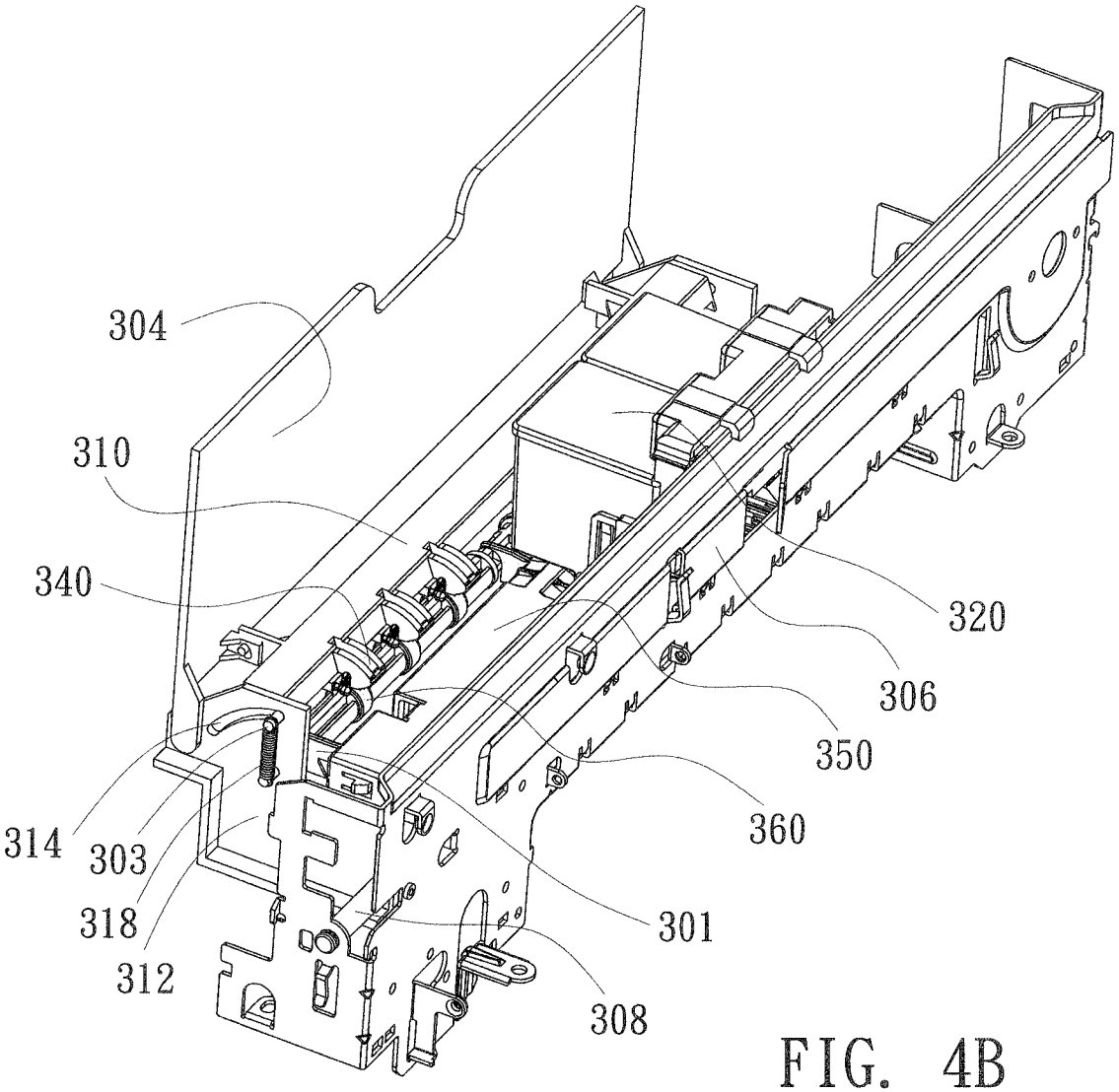
FIG. 4B depicts another perspective view showing the star wheel releasing mechanism in accordance with FIG. 3.

Reference is made to both FIG. 4A and FIG. 4B, which depict perspective views showing the star wheel releasing mechanism in accordance with FIG. 3. The front cover 304 is closed, as shown in FIG. 4A and FIG. 4B. The star wheel releasing mechanism comprises: a base 301; a plurality of exit wheels 360; a star wheel module 310; a pair of supporting plates 312; and the front cover 304. The base includes a first side and a second side. The star wheel module 310 having a first end 303 and a second end (not shown) is movably set on the base 301. The star wheel module 310 includes a plurality of star wheels 340, whose positions correspond to the positions of the exit wheels 360. The pair of supporting plates 312 are disposed respectively on the first side and the second side of the base 301. The star wheel module 310 and the base 301 could be formed in integrally. Each supporting plate 312 includes an arc slot 314, wherein the first end 303 and the second end of the star wheel module 310 are respectively slidable within the arc slots 314. The first end 303 and the second end (not shown) of the star wheel module 310 project from the arc slot 314 for being good to sliding. The arc slot 314 of the present invention is designed for moving the star wheel module 310 forward and downward. The front cover 304 pivoted on the supporting plates 312 and connected to the star wheel module 310 is movable between a first position and a second position. Preferably, the supporting plates 312 and the base 301 are formed as an integral piece.

Figure 5:
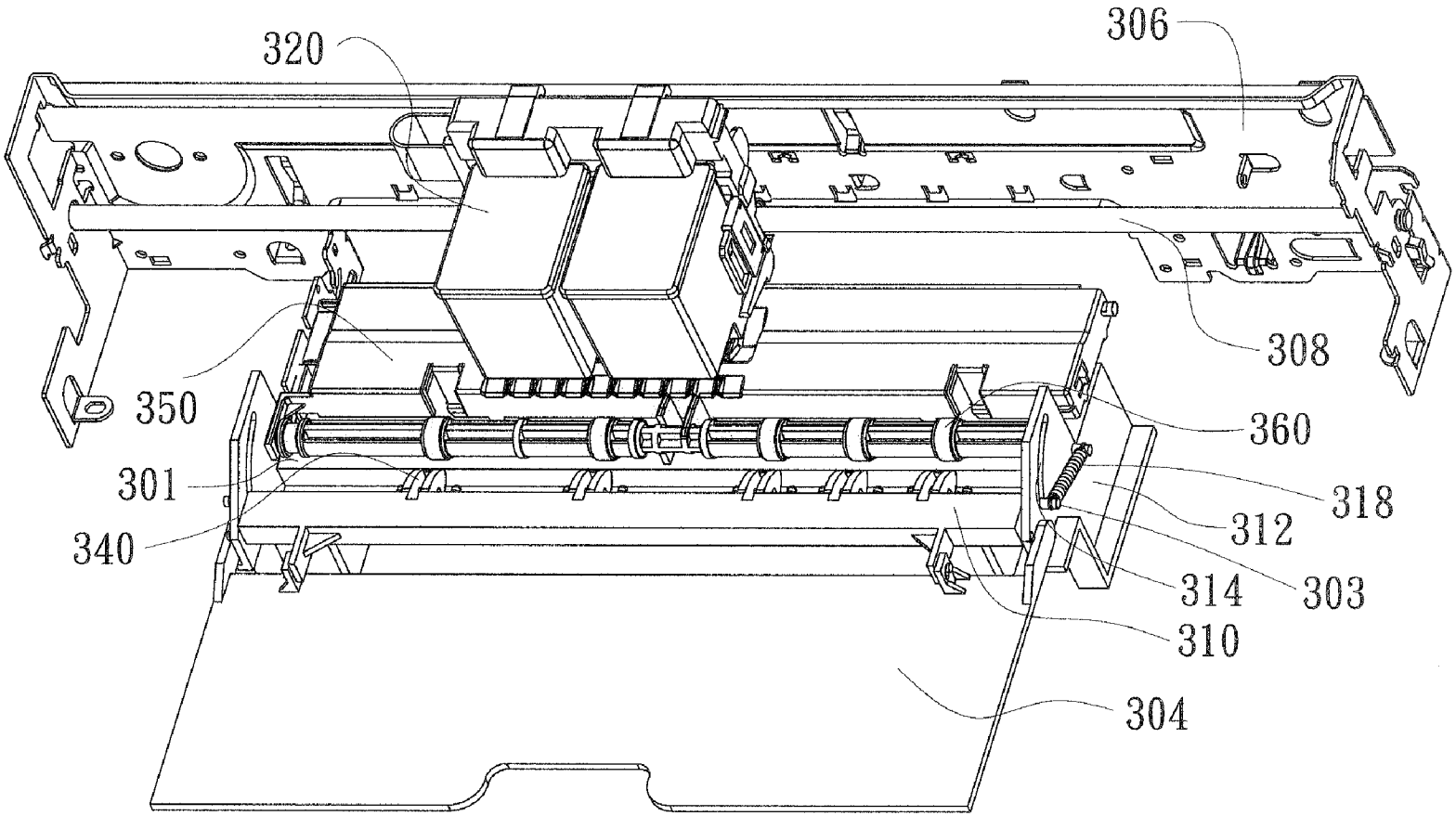
FIG. 5 depicts the other perspective view showing the star wheel releasing mechanism in accordance with FIG. 3.

According to FIG. 4B, when the front cover 304 is positioned in the first position (that is, the front cover 304 is in a closed state), the star wheels 340 are locked with the corresponding exit wheels 360. The printing apparatus 300 could process the printing operation at this time. The printing papers pass the locked star wheels 340 and exit wheels 360, and then pass a slot under the front cover 304 to the output tray 302, as shown in FIG. 3. When the front cover 304 is transferred from the first position (the closed state) to the second position (that is, the front cover 304 is in an opened state), the star wheel module 310 is moved simultaneously. The first end 303 and the second end (not shown) of the star wheel module 310 are respectively slidable within the arc slots 314, so that the star wheels 340 could be separated from the exit wheels 360. Further referring to FIG. 5, which depicts a perspective view showing the star wheel releasing mechanism in accordance with FIG. 3. As shown in FIG. 5, the front cover 304 is in the opened state (in the second position). When the front cover 304 is in the opened state (in the second position), the star wheel module 310 is lower than the printing carriage 350. That is, the horizontal height of the printing carriage 350 is higher than the horizontal height of the star wheels 340, so that the operating space for changing the ink cartridge 320 or eliminate the paper jam increases. According to the preferred embodiment of the present invention, the first position (the closed state) and the second position (the opened state) of the front cover 304 are separated by an angle of substantially 90 degrees. However, the separating angle between the first position and the second position of the front cover 304 could be changed depending on the different applications and products, such as in the range of 180 degrees, rather than limiting of the above-mentioned 90 degrees. Furthermore, the opening angle of the front cover 304 (that is, the separating angle between the first position and the second position of the front cover 304) depends on the length and position of the arc slot 314. Therefore, the opening angle of the front cover 304 could be adapted by changing the length and position of the arc slot 314 for matching different requirements.

According to the present invention, the star wheel releasing mechanism further comprises a fixing device disposed on any supporting plate to hold the front cover 304. When the front cover 304 is in the first position (in the closed state), the fixing device is used for fixing the front cover 304 in the first position. According to the preferred embodiment of the present invention, the fixing device further includes a dot and a pulling force generator, which works for fixing the front cover 304 in the first position when the front cover 304 is closed. As shown in FIG. 4A, the dot 316 is formed on the supporting plates 312. When the front cover 304 is closed, the dot 316 is used for locking the front cover 304 and preventing the front cover 304 from falling. The pulling force generator, such as a compressed spring 318, is disposed on the sidewall of the supporting plates 312, near the backside of the supporting plates 312 and corresponding to the dot 316. The two ends of the pulling force generator connect both the first end 303 of the star wheel module 310, and the supporting plates 312 near the first end 303. When the front cover 304 is closed, the compressed spring 318 is used for pulling the front cover 304 tightly and preventing the front cover 304 from falling.

Figure 6:
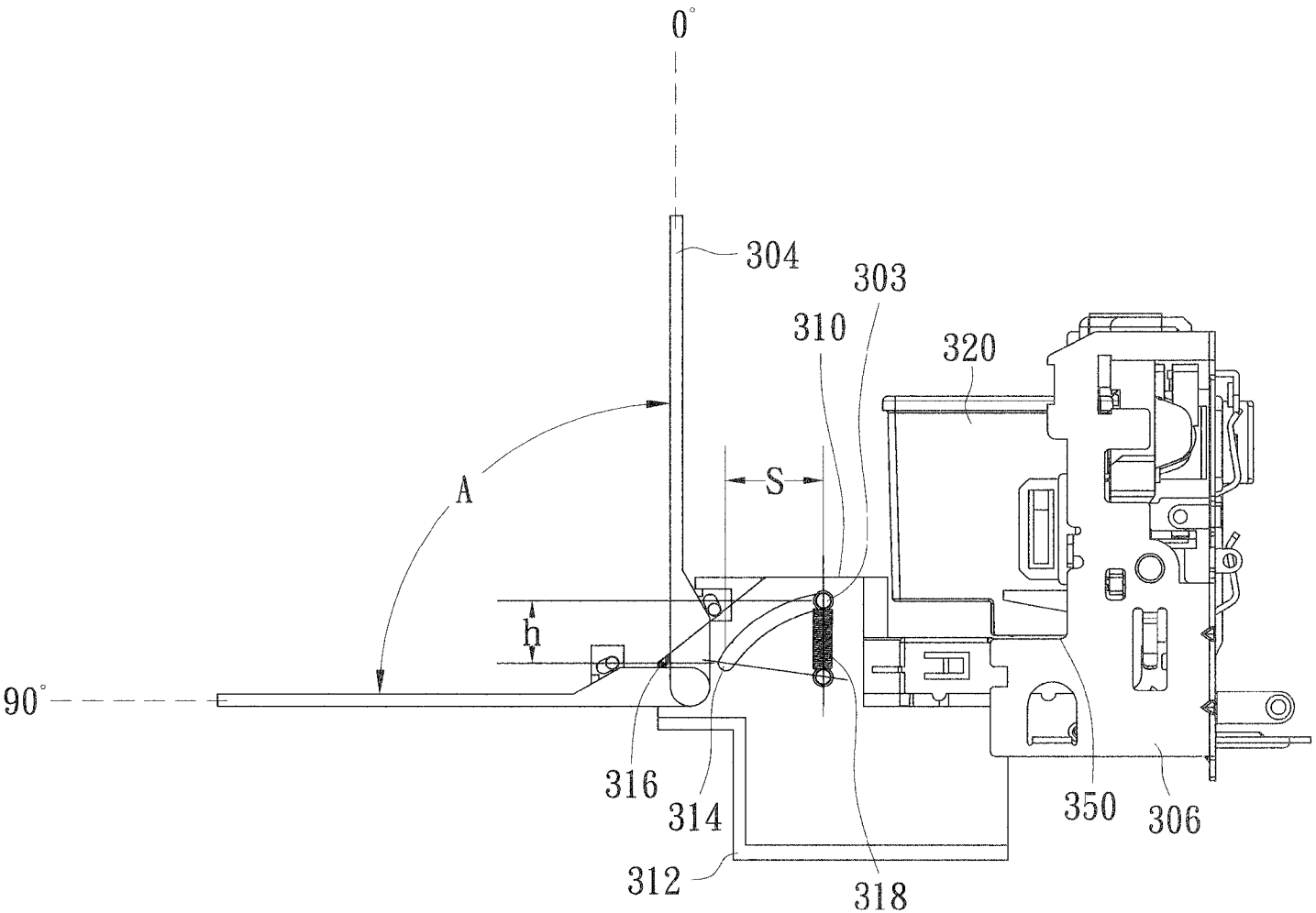
FIG. 6 depicts a cross-sectional view showing the star wheel releasing mechanism in accordance with the preferred embodiment of the present invention.

FIG. 6 depicts a cross-sectional view showing the star wheel releasing mechanism in accordance with the preferred embodiment of the present invention. When the front cover 304 is in the first position (closed state, 0 degree as shown in FIG. 6), the dot 316 is on the back of the front cover 304 for locking the front cover 304. When the front cover 304 is pulled down, the first end 303 of the star wheel module 310 slides along the arc slot 314, so that the star wheel module 310 makes a horizontal displacement S and a perpendicular displacement h. When the front cover 304 is transferred from the first position to the second position (opened state, 90 degrees as shown in FIG. 6), the star wheel module 310 is lower than the printing carriage 350. At this moment, the horizontal displacement S and the perpendicular displacement h is maximum. Therefore, the operating space is large enough for user to change an ink cartridge or eliminate the paper jam.

After changing the ink cartridge and eliminating the paper jam, the front cover 304 is closed. The front cover 304 could be manually closed by the user, or closed by resilient force provided by the compressed spring 318, which could pull the front cover 304 from the second position to the first position.

Furthermore, the maximum angle A that the front cover 304 could be pulled down (that is, the opening angle of the front cover 304), is determined by the length and position of the arc slot 314 and supporting plates 312. For example, as shown in FIG. 6, if the length of the arc slot 314 is shortened, or the position of the arc slot 314 is close to the frame 306, the maximum angle A that the front cover 304 could be pulled down will be smaller than 90 degrees. On the contrary, if the length of the arc slot 314 is lengthened, or the position of the arc slot 314 moves near the front cover 304, the maximum angle A that the front cover 304 could be pulled down will be larger than 90 degrees. No matter the maximum angle A is, the star wheel module 310 is required lower than the printing carriage 350, so that the operating space is larger than prior art for changing an ink cartridge or eliminating the paper jam when the front cover 304 is opened.

Therefore, according to the aforementioned preferred embodiments, one advantage of the star wheel releasing mechanism of the present invention is that the horizontal height of star wheel module 310 could be adapted to be lower than the printing carriage 350 by moving the front cover 304, so that the operating space for changing an ink cartridge or eliminating paper jam increases. Furthermore, there is no additional component required for changing the positions of the star wheel module 310. The manufacturing cost is accordingly reduced.

As is understood by a person skilled in the art, the foregoing preferred embodiments of the present invention are illustrated of the present invention rather than limiting of the present invention. It is intended that various modifications and similar arrangements be included within the spirit and scope of the appended claims, the scope of which should be accorded the broadest interpretation so as to encompass all such modifications and similar structure.

What is claimed is:

1. A star wheel releasing mechanism, installed in a printing apparatus, comprising:

a base including a first side and a second side;

a plurality of exit wheels, disposed on the base;

a star wheel module having a first end and a second end, movably disposed on the base, the star wheel module including a plurality of star wheels, whose positions correspond to the positions of the exit wheels;

a pair of supporting plates, disposed respectively on the first side and the second side of the base, each of the supporting plates including an arc slot, wherein the first end and the second end of the star wheel module are respectively slidable in the arc slots; and a front cover, pivoted on the supporting plates and connected with the star wheel module, the front cover movable between a first position and a second position;

wherein when the front cover is in the first position, the star wheels are locked with the corresponding exit wheels, and when the front cover is transferred from the first position to the second position, the star wheel module moves in linkage, and the star wheels are separated from the exit wheels.

2. The star wheel releasing mechanism according to claim 1, further comprising a fixing device disposed on any supporting plate to hold the front cover when the front cover is in the first position.

3. The star wheel releasing mechanism according to claim 2, wherein the fixing device includes a dot.

4. The star wheel releasing mechanism according to claim 2, wherein the fixing device includes a pulling force generator, connecting both the first end of the star wheel module, and the supporting plates near the first end.

5. The star wheel releasing mechanism according to claim 4, wherein the pulling force generator is a compressed spring.

6. The star wheel releasing mechanism according to claim 1, wherein the pair of supporting plates and the base are formed in integrally.

7. The star wheel releasing mechanism according to claim 1, wherein the first position and the second position are separated by an angle, which is smaller than or equal to 180 degrees.

8. A printing apparatus with star wheel releasing mechanism, comprising:

a printing carriage; and a star wheel releasing mechanism, for use in connection with the printing carriage, comprising:

a base including a first side and a second side;

a plurality of exit wheels, disposed on the base;

a star wheel module having a first end and a second end, movably disposed on the base, the star wheel module including a plurality of star wheels, whose positions correspond to the positions of the exit wheels;

a pair of supporting plates, disposed respectively on the first side and the second side of the base, each of the supporting plates including an arc slot, wherein the first end and the second end of the star wheel module are respectively slidable in the arc slots; and a front cover, pivoted on the supporting plates and connected the star wheel module, the front cover movable between a first position and a second position;

wherein when the front cover is in the first position, the star wheels are locked with the corresponding exit wheels, and when the front cover is transferred from the first position to the second position, the star wheel module moves in linkage, and the star wheels are separated from the exit wheels.

9. The printing apparatus according to claim 8, wherein further comprising a fixing device disposed on any supporting plate to hold the front cover when the front cover is in the first position.

10. The printing apparatus according to claim 9, wherein the fixing device includes a dot, disposed on the supporting plates.

11. The printing apparatus according to claim 9, wherein the fixing device includes a pulling force generator, connecting both the first end of the star wheel module, and the supporting plates near the first end.

12. The printing apparatus according to claim 11, wherein the pulling force generator is a compressed spring.

13. The printing apparatus according to claim 8, wherein the pair of supporting plates and the base are formed in integrally.

14. The printing apparatus according to claim 8, wherein the first position and the second position are separated by an angle, which is smaller than or equal to 180 degrees.

15. The printing apparatus according to claim 8, wherein when the front cover is in the second position, the printing carriage is higher than the star wheel module.

16. The printing apparatus according to claim 15, wherein the printing carriage is higher than the star wheels.

17. The printing apparatus according to claim 8, further comprising an output tray rotatably connected with a front side of the printing apparatus and is disposed outside the front cover for carrying an output paper.

* * * * *

UNITED STATES PATENT AND TRADEMARK OFFICE

CERTIFICATE OF CORRECTION

PATENT NO. : 7,641,331 B2
APPLICATION NO. : 11/380678
DATED : January 5, 2010
INVENTOR(S) : Chih-Ren Chen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 876 days.

Signed and Sealed this

Twenty-first Day of December, 2010

David J. Kappos

David J. Kappos
*Director of the United States Patent and Trademark Office*